United States Patent [19]

Morel et al.

[11] 3,954,253

[45] May 4, 1976

[54] SAFETY BARRIER INCLUDING A METHOD FOR ERECTING THE SAME

[75] Inventors: Henri Morel, Louveciennes; Michel Sere de Lanauze, Saint-Cloud, both of France

[73] Assignee: Rhone-Poulenc-Textile, Paris, France

[22] Filed: Feb. 5, 1974

[21] Appl. No.: 439,826

[30] Foreign Application Priority Data

Feb. 27, 1973 France ..... 73.07236

[52] U.S. Cl. ..... 256/13.1; 256/47

[51] Int. Cl.[2] ..... E04H 17/02; E01F 15/00

[58] Field of Search ..... 256/13.1, 47, 48; 49/34

[56] References Cited

UNITED STATES PATENTS

| | | | |
|---|---|---|---|
| 1,625,716 | 4/1927 | Edwards | 256/13.1 UX |
| 1,913,715 | 6/1933 | MacDonald | 256/13.1 |
| 2,239,667 | 4/1941 | Ahles | 256/13.1 |
| 2,336,038 | 12/1943 | Sawyer | 256/13.1 |
| 2,349,648 | 5/1944 | Brickman | 256/13.1 |
| 2,382,355 | 8/1945 | Warren | 256/13.1 UX |
| 3,233,870 | 2/1966 | Gerhardt | 256/13.1 |
| 3,276,750 | 10/1966 | DeRidder | 256/13.1 |
| 3,351,322 | 11/1967 | Mueller | 256/13.1 |
| 3,377,053 | 4/1968 | Burdett et al. | 52/298 X |
| 3,404,526 | 10/1968 | Thomas | 256/13.1 X |
| 3,512,758 | 5/1970 | Thomas | 256/13.1 |

FOREIGN PATENTS OR APPLICATIONS

| | | | |
|---|---|---|---|
| 1,103,873 | 2/1968 | United Kingdom | 256/13.1 |
| 1,561,509 | 2/1969 | France | 256/13.1 |
| 1,327,110 | 4/1963 | France | 87/2 |

*Primary Examiner*—Dennis L. Taylor
*Attorney, Agent, or Firm*—Sherman & Shalloway

[57] ABSTRACT

A safety barrier includes at least one cable of synthetic textile materials, wherein the cable is composed of a central core having parallel synthetic yarns individually encased in a flexible, insulating adhesive binder which is disposed in abutting concentric layers to form the core and which is encased in an outer protective layer of coated braid. The cable is spaced from a highway by supports having a frangable retaining elements thereon. The safety barrier is erected by placing it on the supports while maintaining the cable under a minimum tension of about 5 tons.

9 Claims, 6 Drawing Figures

SAFETY BARRIER INCLUDING A METHOD FOR ERECTING THE SAME

BACKGROUND OF THE INVENTION

1. Field of the Invention

The present invention relates to safety barriers. More particularly, the present invention relates to safety barriers which utilize cable and to a method for erecting the barriers.

2. Technical Considerations and Prior Art

Over the past several decades, the number of automobiles and other vehicles on highways has increased drastically, while vehicle speeds have also increased. Accordingly, it has become necessary to erect safety barriers along highways to prevent vehicles out of control from leaving their designated lanes and perhaps crashing into other vehicles on the highways or structures positioned adjacent to the highways.

Originally, safety barriers were constructed by simply arranging rows of concrete posts adjacent to highway lanes. Then safety barriers were made by constructing continuous walls of concrete to a height of perhaps a couple of feet above the ground. Currently, it is general practice to make safety barriers of pressed metal strips and, in some instances, steel cables have also been used. These safety barriers, however, leave much to be desired because they are generally static and have low energy absorption. Consequently, when a vehicle strikes these types of barriers, the vehicle is often demolished and the passengers injured due to transmission of shock from the crumbling vehicle to the passengers. In addition, the vehicles often rebound back into the line of traffic, hitting other cars and causing additional accidents. Often, these barriers cause vehicles striking them to turn over, causing additional injury and damage.

In addition to damage to the vehicles and injury to passengers, the afore-described safety barriers are frequently damaged themselves upon impact. Consequently, these safety barriers must be frequently repaired, which is often a time-consuming and expensive procedure.

Steel cables are currently used as highway safety barriers because they generally have high rupture strength and are flexible, which facilitates installation and repair. However, steel cables have certain disadvantages when used as highway safety barriers because they are subject to moisture corrosion, chemical corrosion and electrical corrosion. This corrosion problem could, of course, be avoided by utilizing stainless steel, but the expense of stainless steel prohibits such use. In addition, steel cables have a lot of resistance to traction shock because relatively little energy per weight of material is needed to rupture the cable. This causes the cable to break upon being impacted by a vehicle and to whip around, causing additional hazards to other vehicles on the highway. Although the flexibility of steel cable makes it perhaps easier to install and handle than steel rails and the like, the high density of the cables which is manifest in a low kilometric rupture strength makes the placement of heavy cables suspended between spaced supports both difficult from an engineering standpoint and cumbersome. In order to avoid corrosion, periodic maintenance such as greasing, painting and tarring is necessary which, of course, is disagreeable, dirty and hazardous work. For these reasons, steel cables are not often used as safety barriers even though they might initially appear to have certain advantages over other types of safety barriers. Utilization of steel cables in safety barriers is exemplified by the British Patent No. 1,012,212 issued to H. M. Bender.

In order to overcome the difficulties encountered in utilizing steel cables as safety barriers, the prior art suggests utilizing a combination cable which has both steel strands and synthetic strands. Such a concept is exemplified by British Patent No. 1,272,588 issued to R. E. Campbell. In this patent, the strands composing the cable are made of helically wound filaments which may be either steel or alternately steel and synthetic materials.

Utilization of a rope or cable as a safety barrier wherein the rope or cable is manufactured from synthetic material such as nylon, rayon or the like is disclosed by U.S. Pat. No. 2,841,046 issued to L. A. Runton. In this particular patent, the barrier is not utilized for arresting motion of wayward highway vehicles, but is rather utilized to absorb shock from opening parachutes or as a harnass to capture runaway jet airplanes. The particular rope or cable disclosed in this U.S. patent utilizes 300,000 or more strands of crimped continuous filaments enclosed in a sheath. The cable disclosed in this U.S. patent, however, due to its structural complexity and expense, would not be suitable for extensive use as a highway safety barrier.

SUMMARY OF THE INVENTION

A primary object of the instant invention is to provide a highway safety barrier which avoids the difficulties encountered in utilizing barriers of the afore-described type.

It is a further object of the present invention to provide a new and improved safety barrier for highways, wherein the barrier includes a cable made of synthetic textile materials.

It is an additional object of the instant invention to provide a new and improved safety barrier for highways which utilizes a cable of synthetic textile materials that is held at a pre-determined distance from the highway by supports and is tensioned between resistant anchorages.

It is still another object of the instant invention to provide a new and improved highway safety barrier which will arrest motion of a wayward vehicle with minimum damage to the vehicle, passengers in the vehicle and the barrier itself.

It is a further object of the instant invention to provide a new and improved highwaY safety barrier wherein maintenance of the barrier is kept to a minimum.

It is still a further object of the instant invention to provide a new and improved safety barrier for highways wherein the barrier utilizes a cable of synthetic textile material which is supported by a system which resists any tendency for a vehicle striking the barrier to turn over.

It is still another object of the instant invention to provide a new and improved safety barrier for highways wherein the barrier resists the tendency to rebound impacting vehicles back into moving traffic.

It is an additional object of the instant invention to provide a new and improved safety barrier for highways wherein the barrier utilizes a cable of synthetic textile material which will not rupture under expected impact loads.

In view of these and other objects, a safety barrier for highways contemplated by the instant invention includes at least one cable of synthetic textile material which is held supported from the highway in a state of tension. The cable itself is comprised of a central core of parallel strands of synthetic yarn encapsulated in a flexible, insulating binder which is adhered to each strand of yarn. The binder is disposed in concentric layers of abutting circles and is encased in an outer protective layer of coated braid.

A method for erecting a safety barrier of the aforementioned type includes mounting the cable on rigid supports to retain the cable at a distance of 40 cm to 1 m above the highway while maintaining a tension of at least 5 tons on the cable as the cable is anchored at each end. In order to removably retain the cable on the supports, each support has a pair of flanges projecting therefrom between which the cable rests. A loop of strap iron is positioned between the flanges and over the cable. One of the arms of the loop has a frangable section therein to facilitate rupture of the loop when a certain force is imparted to the cable by a vehicle striking the cable. In order to provide for convenient removal of and lowering of the cable, the strap iron is fixed to the support by a removable pin.

DETAILED DESCRIPTION OF THE INVENTION

Figure 1:
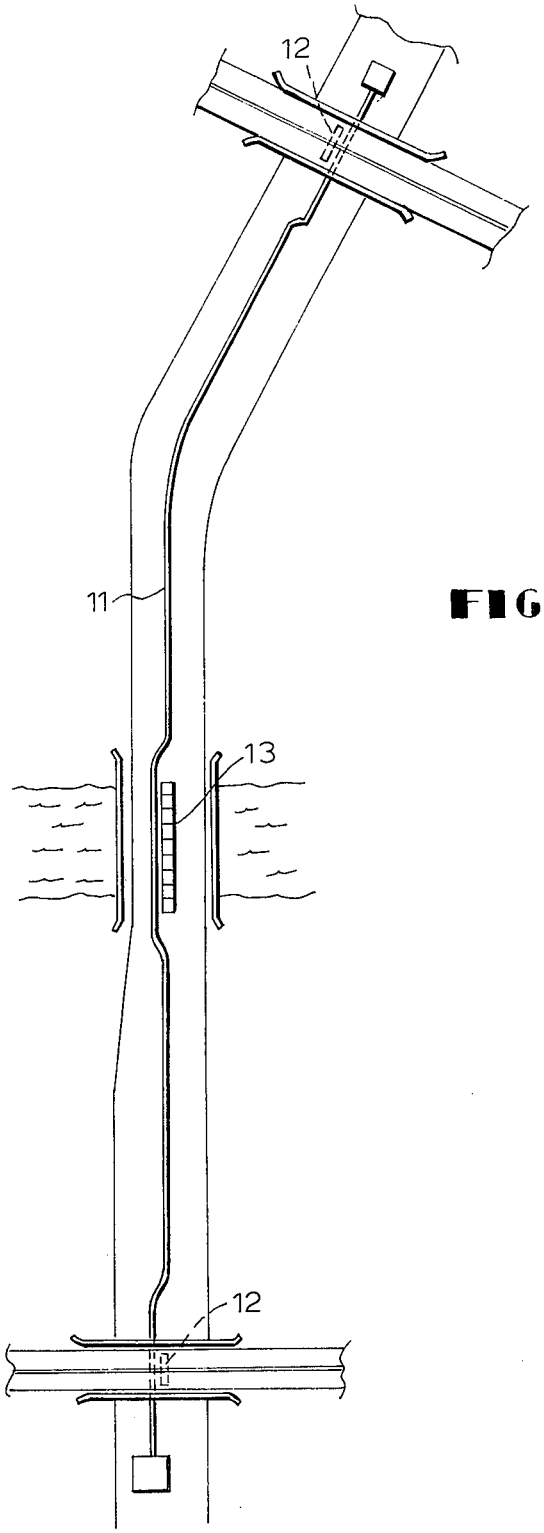
FIG. 1 is a schematic illustration of how a cable according to the invention may be installed to form a safety barrier between the highway lane and obstacles adjacent to the highway lane.

Referring now to FIG. 1, there is shown a top view of how a safety barrier, designated generally by the numeral 11, is utilized to shield highway lanes from obstacles such as piers 12—12 and girders 13. In applicant's invention, safety barrier 11 utilizes a flexible cable which, due to its flexibility, is able to follow the profile of the highway with which it is used. As the highway dips and curves to follow the profile of the terrain upon which it is laid and as the highway passes obstacles, the cable due to its flexibility will readily conform to the desired configuration. In the illustration shown in FIG. 1, it is to be understood that the line followed by the barrier 11 may go on either side of the piers 12—12 or girder 13.

Figure 2:
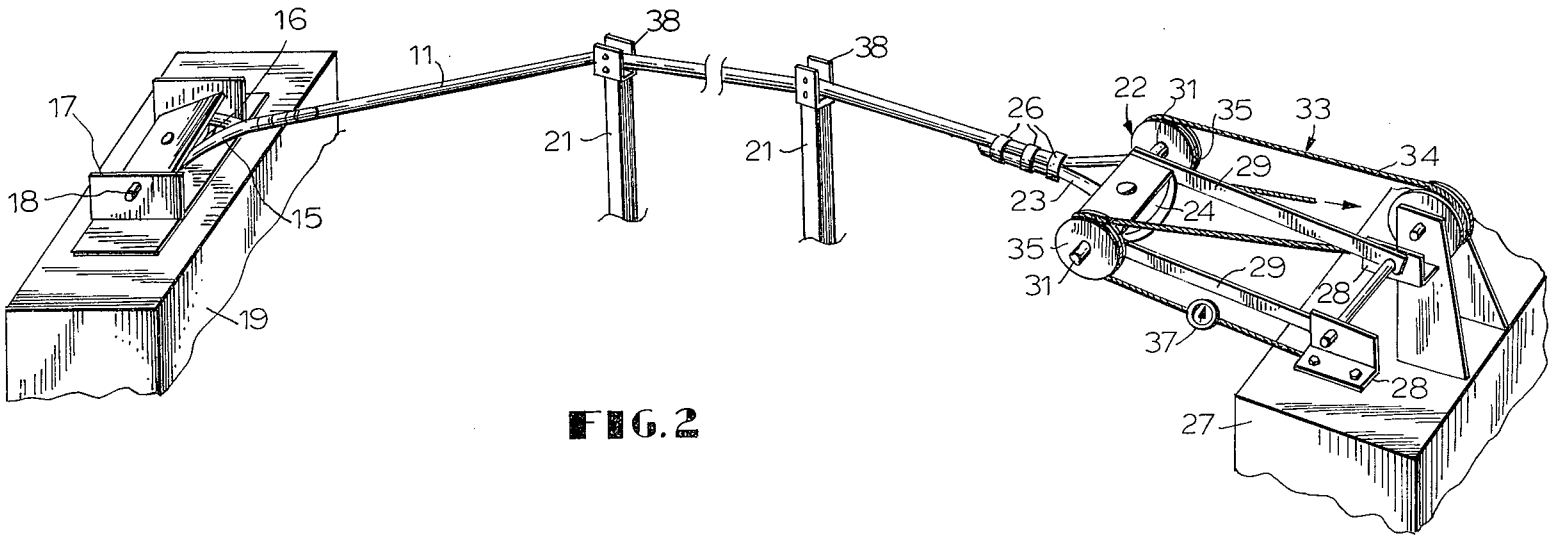
FIG. 2 is a perspective illustration showing how the cable of FIG. 1 is, according to the invention, anchored and supported.

Referring now to FIG. 2, there is shown an example of how a barrier 11 consisting of a single cable may be installed in place. One end of the cable 11 is formed into a loop 15 that is passed around a large grommet 16. The grommet 16 is pivoted to a bracket 17 by projecting pins 18 (only one of which is shown). The bracket 17 is, in turn, fixed to an anchor 19 that is, in the preferred embodiment, made of concrete and embedded in the ground in a conventional manner.

The cable 11 is then passed over a plurality of supports 21—21, two of which are shown for convenience, and secured to a tensioning device, designated generally by the numeral 22. In the preferred embodiment, the cable has a loop 23 formed at the end which is secured to the tensioning device and a loop passes around a grommet 24. In order to conveniently form the loop from the free end of the cable 11, bands 26 may be wrapped about a portion of the cable 11 and the free end.

The tensioning device 22 is secured to a tensioning anchor 27 by a pair of L-shaped brackets 28—28. Extending from the brackets 28—28 are a pair of arms 29—29 to which the grommet 24 is mounted by sliding pins or axles 31—31 that are received in slots (not shown) in the arms. Tension may be applied to the cable 11 by a pulley arrangement, designated generally by the numeral 33, such as that shown in which a cable 34 is looped around a pair of pulleys 35—35 journalled on the pins or axis 31. The cable 34 is placed under tension to draw the barrier cable 11 and thus tension the barrier cable. A tensionometer 37 may be inserted in the cable 34 so that tension on the barrier cable 11 may be monitored. Although the barrier cable 11 is shown tensioned between concrete blocks 19 and 27 which are embedded in the ground, it is also feasible to anchor the barrier cable 11 to structures such as bridge piers or retaining walls (not shown).

When the barrier cable 11 is tensioned, there follows a relaxation that corresponds to a decrease in load. Consequently, the tension applied in installing the cable is greater than the operating tension of the cable. As a general rule, therefore, the tension drops rapidly under the effect of relaxation and then decreases slowly over the course of time to become stabilized after about 2 weeks. When installing the cable, the elongation of the cable must therefor be taken into account so that the final tension in the cable will stabilize at a desired value.

The embodiment shown in FIG. 2 is utilized with cable barriers which are relatively short or intermediate in length. If the cable barrier 11 happens to be long, tensioning will be required at both ends and a tensioning device such as 33 will be secured to opposite ends of the barrier cable.

Figure 3:
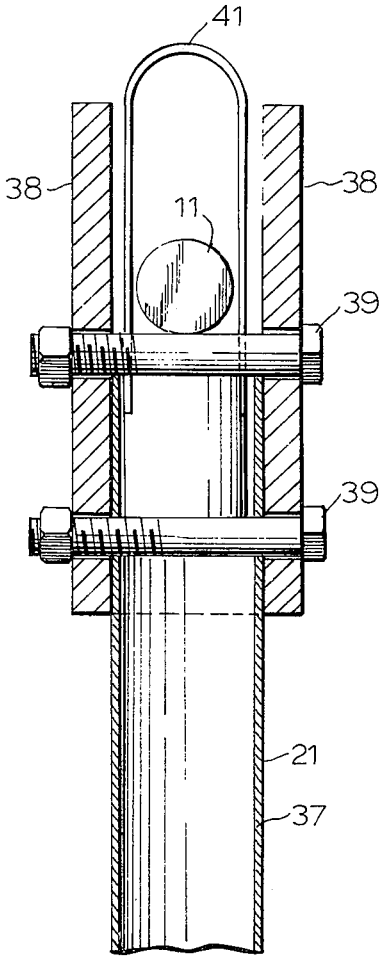
FIG. 3 is an enlarged view of the top section of a support, such as those shown in FIG. 2, wherein the cable is held between a pair of flanges and retained in place by a strap iron loop.

Referring now to FIG. 3, there is shown one embodiment of how the barrier cable 11 is mounted on one of the supports 21. The support 21 has a tubular section 37 which is at one end embedded in the ground and has a pair of flanges 38—38 projecting above the other end. The flanges 38—38 are secured to the tubular section 37 by a pair of blots 39—39 which pass through holes in the tubular section 37. A strap iron loop 41 is positioned between the flanges 38 and extends over the barrier 11. The top of the loop is spaced from the cable 11 a distance which is greater than the diameter of the cable and one of the arms of the loop has a frangable section therein so that shock applied to the cable will rupture the loop to prevent the cable from shearing.

Figure 4:
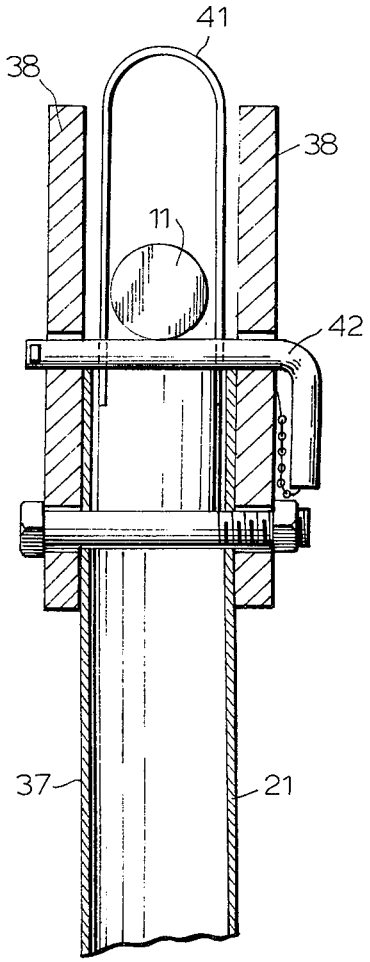
FIG. 4 is a sectional view of another embodiment of a support, such as one of those shown in FIG. 2, wherein the strap iron loop is retained in place by a removable pin so that the cable may be lowered to allow emergency passage across highway medians and through side exits.

FIG. 4 is another embodiment of the cable support wherein the cable 11 is held between a pair of flanges 38—38 that are retained in projected condition by a removable pin 42. When it is desired to remove the cable 11 from the support 37, the pin 42 is removed so that the flanges 38 may pivot downwardly and the cable 11 may be slid off. This embodiment is utilized principally to allow lowering of the barrier cable 11, thereby permitting emergency passage across highway median strips and through normally blocked side exits.

Figure 5:
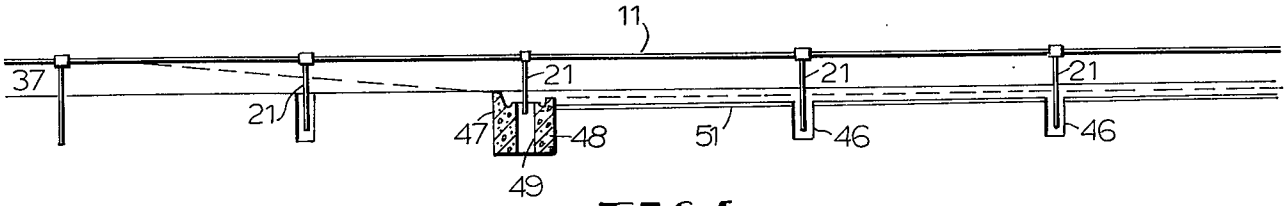
FIG. 5 is a schematic illustration showing how the cable may be removed from its supports and lowered to allow for emergency crossing of the cable path to allow crosing of the highway median and passage through side exits.

The embodiment of the support shown in FIG. 4 is utilized in situations such as that illustrated in FIG. 5 in which a barrier cable 11 is shown guarding an emergency passage between two highway lanes (not shown). In this situation, the supports 21 are mounted in sleeves 46 which project below the surface of the roadway. The supoorts 21 are simply slid into the sleeves 46 so that they may be taken out of the sleeves and laid flat. In order to allow passage of vehicles between the two highway lanes, the strap irons 41 are removed from the supports 21 and a cable lowering device 47 is uncovered and activated. The lowering device 47 generally comprises a concrete block 48 having a sheath 49 therein in which one of the supports 21 is received. After the strap irons are removed, the pins 42 (FIG. 4) are taken out and the barrier cable 11 is slid off of the supports 21 and lowered by the lowering device 21 into a conduit 51 extending beneath the barrier cable 11. After the barrier cable 11 is removed, the supports 21 are simply lifted from the sleeves 46 and removed. The conduit 51 may then be covered over to allow passage of emergency vehicles.

Figure 6:
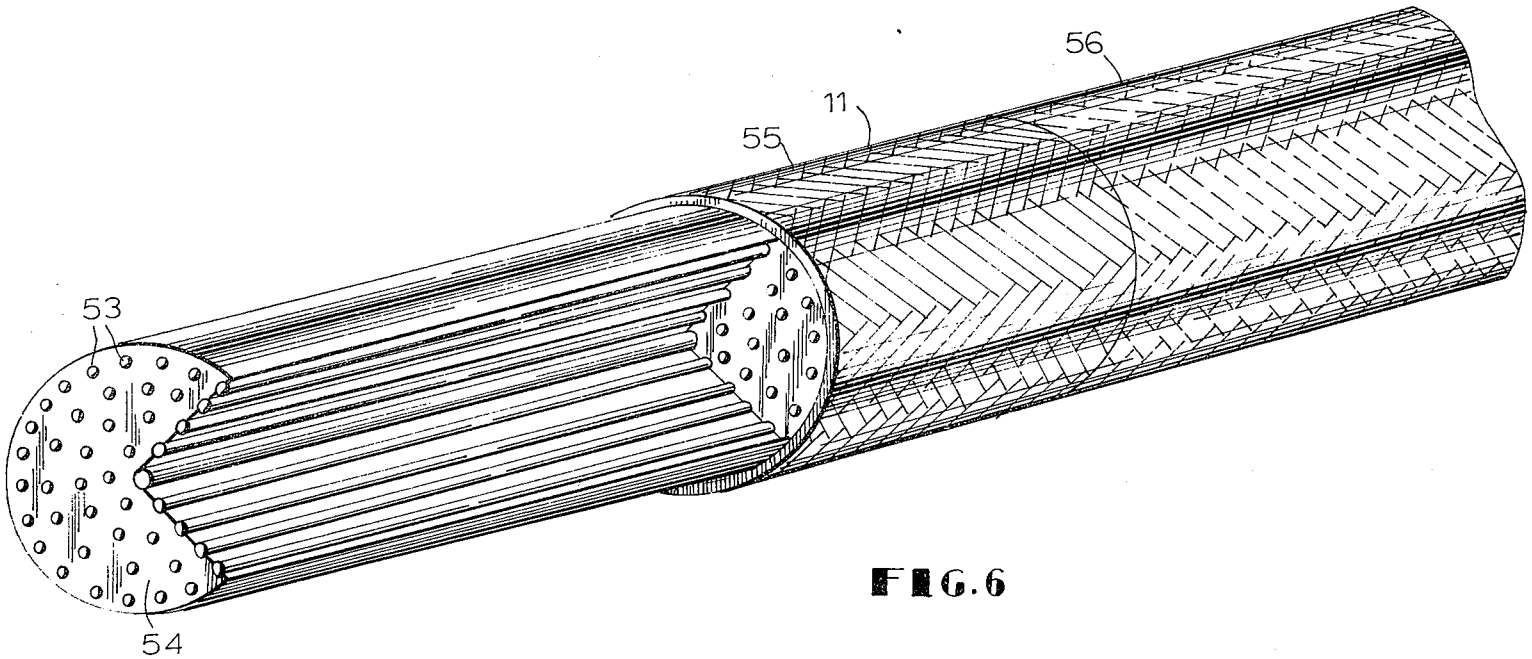
FIG. 6 is a perspective view of a cable which is utilized in accordance with the principles of the instant invention showing the cable in section to illustrate the structure of the cable.

Referring now to FIG. 6, there is shown a sectional view of the barrier cable 11. As seen in this figure, strands of synthetic yarn 53 extend parallel to one another while retained in spaced relation within a binder 54. The binder 54 is, in turn, wrapped with a layer of braid 55 that is, in turn, coated by a coating 56.

The strands of yarn 53 preferably have little or no twist and the cable is manufactured according to the disclosure in applicant's French Patent No. 1,327,110, filed Mar. 28, 1962, entitled "Process for Manufacture of Rope, Cables, Webbing and Similar Articles, and New Products that are Obtained Thereby". This cable offers advantages inherent in synthetic rope such as lightness, resistance to rot, high rupture energy, and resistance to corrosion. In addition, this type of cable has the advantage of steel cables in that it has high rupture strength, low elongation, abrasion resistance, transverse density and dimensional stability. Accordingly, this type of cable embodies in one structure the advantages of both synthetic rope and steel cables. This type of cable has a high kilometric rupture strength which is greater than other known materials that operate while in traction since the kilometric rupture strength is between 30 and 60. Furthermore, this type of cable cannot rot, it is solid and compact, and it does not absorb water. Consequently, it cannot freeze or increase in weight while in use. Finally, the core of this type of cable is immune to environmental attacks which is important since the cable is used as a safety barrier.

The barrier cable 11 forms an elastic system wherein when a vehicle strikes the cable, the cable is elastically deflected. This deflection must neither be too great or too small in order for the cable 11 to act as a safety barrier. In installing the cable 11, the cable must be supported so that there is a slight dynamic deflection upon impact in combination with a minimal residual static deflection so that the vehicle does not decelerate too fast and so that the cable rebounds against the vehicle with a dampening effect after the initial impact.

By utilizing a cable such as that disclosed in the afore-mentioned French Patent No. 1,327,110, approximately 10,000 meters of cable may be stored on a single reel carriage for distribution along highways at desired locations. Accordingly, the transportation problems encountered in distributing other types of safety barrier materials are drastically reduced by utilizing the barrier cable 11. Generally, the distance between the supports 21 should be approximately four meters. However, this distance may be varied for purposes of convenience. It has been found that a support height in the range of forty centimeters to one meter positions the barrier cable 11 for optimum safety.

An added safety feature of utilizing a barrier cable such as the cable 11 is that the cable may be pained with a reflective paint so as to mark the highway on which it is used at night.

EXAMPLES

The following examples I through V illustrate the behavior of safety barriers utilized in accordance with the principles of this invention, wherein vehicles of different weights impact against the barrier at various speeds and at various angles.

TABLE

| Example Number | Cable Tension | Vehicle Weight kg | Vehicle Speed km/h | Angles Entrance | Angles Exit | Maximum Deflection Dynamic | Maximum Deflection Static |
|---|---|---|---|---|---|---|---|
| I | 2 ϕ 36 mm 2 × 6 t | 1250 | 66 | 15° | 10° | 1.10 | — |
| II | 1 ϕ 46 mm 16 t | 1140 | 80 | 30° | 30° | 1.68 | 0.30 |
| III | 1 ϕ 46 mm 16.3 t | 1120 | 100 | 20° | 14° | 1.34 | 0.15 |
| IV | 1 ϕ 46 mm 16.6 t | 1150 | 105 | 18° | 10° | 1.30 | 0.16 |
| V | 1 ϕ 46 mm 16.6 t | 880 | 100 | 20° | 10° | 1.24 | 0.10 |

In Example I, the barrier was created by utilizing two cables having a diameter of 36 mm and tensioned at 6 tons each. The synthetic strands of yarn utilized in the cable were made of polyamide 66. The cables were positioned 65 cm above the ground and were rigidly connected to one another by horizontal cross pieces which were 2 m long. The supports 21 (FIG. 2) were spaced 4 m apart.

In Examples II through V, a single cable having a diameter of 46 mm was utilized and held at a distance 60 cm above the ground by steel tubing supports 21 spaced a distance of 4 m apart. The yarns of the cable in these examples were polyethylene glycol terephthalate.

In interpreting the above table, the entrance angles are the angles formed by the axis of the vehicle with the barrier cable at the moment of impact, and the exit angle is the angle formed by the axis of the vehicle with the cable immediately after impact. The maximum cable deflection is termed "maximum static deflection" and the maximum dynamic deflection indicates the maximum deflection of the line of the vehicle wheel adjacent to the point of impact of the vehicle with the cable.

During these tests, no vehicle passed through the barrier cable by either breaking the cable, going over the cable or going under the cable. As the vehicle struck the cable, the cable formed a dynamic pocket conforming to the configuration of the vehicle. The supports 21 holding the cable up bended and the strap iron loops 41 yielded to release the cables from between the flanges 38. The vehicles upon striking the cables slid therealong and came to rest facing in their original direction without either turning over or spinning around. If passengers had been in the vehicles, they would have incurred no physical injuries. Moreover, the damage to the vehicle bodies (which were cars having mono-coupe constructions and square fronts) did not amount to more than 30 to 35% of the cost of a new car.

The afore-mentioned descriptions and examples are merely representative of embodiments of the instant invention, the scope of which should be limited only by the following appended claims.

What is claimed is:

1. A safety barrier for use along highways comprising:

at least one cable, wherein said cable includes a central core of parallel synthetic textile yarns surrounded by an outer protective layer;

spaced supports for supporting the cable in vertical spaced relation from the highway retaining means for securing the cable on the spaced supports, wherein the retaining means includes on each support a pair of vertically projecting flanges, between which the cable is mounted and a loop of strap iron positioned between the flanges and around the cable, wherein a portion of the loop includes rupture means which ruptures upon impact against said cable, allowing said cable to remain in vertical spaced relation after impact, and means secured to opposite ends of the cable for tensioning the cable over the support means.

2. The safety barrier of claim 1, wherein the loop of strap iron is fixed to the support by a removable pin for convenient removal and lowering of said cable.

3. A safety barrier as described in claim 1, wherein there is included a flexible, insulating and adhesive binder for encasing each yarn in spaced relation within said core, wherein said binder is disposed in concentric layers of abutting circles.

4. A safety binder as defined in claim 3, wherein the outer protective layer is a coated braid.

5. A safety barrier as defined in claim 3, wherein the synthetic textile yarns used in the cable are polyamide.

6. A safety guard as defined in claim 3, wherein the synthetic textile yarns of the cable are manufactured from a polyester.

7. The safety barrier of claim 1, wherein the loop of strap iron is fixed to the support by a removable pin.

8. The safety barrier of claim 1, wherein the supports are removably seated in sleeves which project from positions adjacent the highway.

9. The safety barrier of claim 1, wherein the safety barrier is mounted between two lanes of the highway over a gutter extending between the lanes and wherein means are provided for lowering the cable into the gutter, said lowering means being positioned at one end of said cable.

* * * * *

UNITED STATES PATENT AND TRADEMARK OFFICE

CERTIFICATE OF CORRECTION

PATENT NO. : 3,954,253

DATED : May 4, 1976

INVENTOR(S) : MOREL, ET AL.

It is certified that error appears in the above-identified patent and that said Letters Patent are hereby corrected as shown below:

Claim 4, line 1, delete "binder", insert -- barrier --

Signed and Sealed this

Thirteenth Day of July 1976

[SEAL]

*Attest:*

RUTH C. MASON
*Attesting Officer*

C. MARSHALL DANN
*Commissioner of Patents and Trademarks*